US006402078B1

(12) United States Patent
Brockmueller et al.

(10) Patent No.: US 6,402,078 B1
(45) Date of Patent: Jun. 11, 2002

(54) AUTOMATIC WINDER DOFFING AND RE-TUBING

(75) Inventors: Bernd Brockmueller, Advance; Charles A. Garwood, Shelby; Thomas J. Kochanowicz, Lexington, all of NC (US)

(73) Assignee: PPG Industries Ohio, Inc., Cleveland, OH (US)

( * ) Notice: Subject to any disclaimer, the term of this patent is extended or adjusted under 35 U.S.C. 154(b) by 0 days.

(21) Appl. No.: 09/572,537

(22) Filed: May 17, 2000

Related U.S. Application Data

(60) Provisional application No. 60/136,537, filed on May 28, 1999, now abandoned.

(51) Int. Cl.[7] ..... B65H 54/26; B65H 67/04

(52) U.S. Cl. ..... 242/473.6; 242/473.9; 242/118.3

(58) Field of Search ..... 242/166, 118.3, 242/473.6, 473.7, 473.8, 473.9, 920

(56) References Cited

U.S. PATENT DOCUMENTS

| | | | | | |
|---|---|---|---|---|---|
| 822,224 | A | * | 5/1906 | Ryden | 242/118.3 |
| 1,866,622 | A | * | 7/1932 | Corthell | 242/166 X |
| 3,301,506 | A | * | 1/1967 | Bagby | 242/166 |
| 3,388,444 | A | * | 6/1968 | Benson | 242/166 X |
| 3,977,615 | A | * | 8/1976 | Owens et al. | 242/473.9 |
| 3,997,306 | A | | 12/1976 | Hedden | |
| 4,022,392 | A | * | 5/1977 | Thomas, Jr. et al. | 242/473.9 |
| 4,023,743 | A | | 5/1977 | Schippers | |
| 4,052,016 | A | | 10/1977 | Cunningham et al. | |
| 4,340,187 | A | * | 7/1982 | Schippers et al. | 242/473.7 |

(List continued on next page.)

FOREIGN PATENT DOCUMENTS

| | | |
|---|---|---|
| DE | 0381844 | 8/1990 |
| EP | 0427994 | 5/1991 |

OTHER PUBLICATIONS

*The Manufacturing Technology of Continuous Glass Fibres*, by K. L. Loewenstein (3rd Ed 1993) pp. 165–172.

*The Manufacturing Technology of Continuous Glass Fibres*, by K. L. Loewenstein (3rd Ed 1993) pp. 237–291.

*The Manufacturing Technology of Continuous Glass Fibres*, by K. L. Loewenstein (3rd Ed 1993) pp. 30–44, 47–60, 115–135.

*The Manufacturing Technology of Continuous Glass Fibres*, by K. L. Loewenstein (3rd Ed 1993) pp. 85–107.

*Encyclopedia of Polymer Science and Technology*, vol. 6 (1967), pp. 501–712.

*Primary Examiner*—Michael R. Mansen
(74) *Attorney, Agent, or Firm*—Andrew C. Siminerio

(57) ABSTRACT

An apparatus for doffing and re-tubing a fiber winder Includes: (a) an assembly support; (b) a support plate vertically movable along the assembly support; (c) a first assembly support extending from the support plate for supporting a forming package assembly having an adapter package and at least one forming package extending around the adapter tube, the first assembly support including: (i) at least one gripper movable along the first assembly support between a first position and a second position and capable of engaging the forming tube assembly; and (ii) guides to support and guide the forming package assembly an the first assembly support; (d) a second assembly support extending from the support plate for supporting a forming tube assembly having an adapter tube and at least one forming tube extending around the adapter tube, the second assembly support including: (i) at least one pusher movable along the second assembly support between a first position and a second position and capable of engaging the forming tube assembly; and (ii) guides to support and guide the forming tube assembly on the second assembly support; and (e) a transport system capable of supporting the assembly support and horizontally moving the assembly support.

10 Claims, 6 Drawing Sheets

U.S. PATENT DOCUMENTS 4,427,158 A 1/1984 Conrad
4,542,106 A 9/1985 Sproull
4,591,106 A 5/1986 Gay
4,621,778 A * 11/1986 Paravella et al. ..... 242/473.7
4,927,869 A 5/1990 Dana et al.
5,393,003 A * 2/1995 Watermann ..... 242/473.6
5,568,720 A * 10/1996 Teich et al. ..... 242/473.6 X
5,603,460 A * 2/1997 Reid ..... 242/118.3 X
5,769,342 A 6/1998 Makitka
5,789,329 A 8/1998 Eastes et al.
5,883,021 A 3/1999 Beer et al. ..... 442/172
5,883,023 A 3/1999 Martine et al.
5,908,689 A 6/1999 Dana et al. ..... 428/219
6,047,915 A * 4/2000 Jaschke ..... 242/473.9

* cited by examiner

AUTOMATIC WINDER DOFFING AND RE-TUBING

CROSS REFERENCE TO RELATED PATENT APPLICATION

This application claims the benefit of U.S. Provisional Application No. 60/136,537, filed May 28, 1999, now abandoned.

BACKGROUND OF THE INVENTION

1. Field of the Invention

The present invention relates to the production of glass fibers, and more particularly to removing fiber forming packages from a fiber winder and replacing the packages with forming tubes for production of subsequent forming packages.

2. Technical Considerations

In the manufacture of wound strand packages, and in particular glass fiber strand packages, in which continuous strands of fibers are wound around a forming tube on a rotating collet to form the strand package, the problem occurs of removing the package once it has become full, and replacing the package with another forming tube, preferably while not interfering with the continuous strand forming process. It is known in the production of glass fiber strand packages to utilize turret winders so as to minimize the impact of stopping the winder to remove, or doff, the packages from the collet. Although the use of turret winders maintains a generally continuous glass fiber forming operation, they add to the complexity of removing the packages from the collet and re-tubing the collet for the next forming package. Further complicating this operation, oftentimes the collet is used to form multiple packages that must be removed from the collet and replaced with new forming tubes for the next set of forming packages without interrupting the fiber forming process.

U.S. Pat. No. 4,591,106 discloses a method for automatically doffing a full forming package of a rotating collet. A doffing cup is extended over the rotating forming package and is rotated at a speed slightly greater than the speed of the forming package. A liner within the cup is then inflated to contact and grip the strand surface of the forming package. The cup is then retracted to remove the forming package from the rotating collet.

U.S. Pat. No. 4,052,016 discloses a method and apparatus for removing multiple forming packages from a collet by engaging the rearmost forming package on a rotatable collet and pulling this package along the collet to strip the other forming packages from the collet.

EP 0 427 994 B1 discloses an apparatus for loading forming tubes on a winder, wherein the apparatus includes a reservoir for storing forming tubes to be mounted on the collet of the winder.

It would be advantageous to provide a system that reduces the complexity and increases the speed of doffing several strand packages from a winder and re-tubing the collet.

SUMMARY OF THE INVENTION

The present invention provides a forming tube assembly comprising: an adapter tube configured to extend over at least a portion of a collet of a winder; and at least one forming tube extending around at least a portion of the adapter tube. In one nonlimiting embodiment of the invention, the adapter tube of the forming tube assembly is made of polypropylene and includes a slit extending along at least a portion of the length of the adapter tube. In another nonlimiting embodiment of the invention, the forming tube assembly includes at least two forming tubes and a starter band extending around a portion of the adapter tube.

The present invention also provides a forming package assembly comprising: an adapter tube; and at least one forming package extending around the adapter tube. In one nonlimiting embodiment of the invention, the adapter tube of the forming package assembly is made of polypropylene and includes a slit extending along at least a portion of the length of the adapter tube and the forming package comprises a forming tube extending around the adapter tube and at least one continuous fiber strand wound around the forming tube. In another nonlimiting embodiment of the invention, the forming tube assembly includes at least two forming packages and a starter band extending around a portion of the adapter tube.

The present invention further provides a method of forming and doffing a forming package, comprising the steps of: (a) positioning a forming tube assembly on a collet of a winder, the assembly comprising: (i) an adapter tube which extends over at least a portion of the collet; and (ii) at least one forming tube extending around at least a portion of the adapter tube; (b) winding at least one continuous fiber strand around the at least one forming tube to form a forming package; and (c) simultaneously removing the adapter tube and forming package from the collet. In one nonlimiting embodiment of the invention, the forming tube assembly includes a plurality of forming tubes, and the winding step includes the step of winding at least one fiber strand around each forming tube of the plurality of forming tubes to form a plurality of forming packages, and the sliding removing step includes the step of simultaneously removing the adapter tube and the plurality of forming packages from the collet.

The present invention also provides a method of re-tubing a collet of a winder, comprising the steps of: positioning at least one forming tube around at least a portion of an adapter tube to form a preassembled forming tube assembly; and positioning the forming tube assembly over a collet of a winder.

The present invention further provides an apparatus for doffing and re-tubing a fiber winder, comprising: (a) an assembly support; (b) a support plate vertically movable along the assembly support; (c) a first assembly support extending from the support plate for supporting a forming package assembly comprising an adapter tube and at least one forming package extending around the adapter tube, the first assembly support comprising: (i) at least one gripper movable along the first assembly support between a first position and a second position and capable of engaging the forming tube assembly; and (ii) guides to support and guide the forming package assembly on the first assembly support; (d) a second assembly support extending from the support plate for supporting a forming tube assembly comprising an adapter tube and at least one forming tube extending around the adapter tube, the second assembly support comprising: (i) at least one pusher movable along the second assembly support between a first position and a second position and capable of engaging the forming tube assembly; and (ii) guides to support and guide the forming tube assembly on the second assembly support; and (e) a transport system capable of supporting the assembly support and horizontally moving the assembly support;

The present invention also provides a method of removing at least forming package from the collet of a fiber winder and positioning at least one forming tube on the collet, comprising: (a) providing a doffing and re-tubing device having a first assembly support for supporting a forming package assembly comprising an adapter tube and at least one forming package extending around the adapter tube, and a second assembly support for supporting a forming tube assembly comprising an adapter tube and at least one forming tube extending around the adapter tube; (b) aligning the first assembly support with a collet of a winder having a forming package assembly such that an end of the first support is close an end of the collet; (c) engaging the adapter tube of the forming package assembly with the first assembly support; (d) sliding the forming package assembly off the collet and onto the first assembly support; (e) aligning the second assembly support with the collet of the winder such that an end of the second assembly support is close the end of the collet; and (f) sliding a forming tube assembly positioned on the second assembly support off the second assembly support and onto the collet.

DETAILED DESCRIPTION OF THE INVENTION

Figure 1:
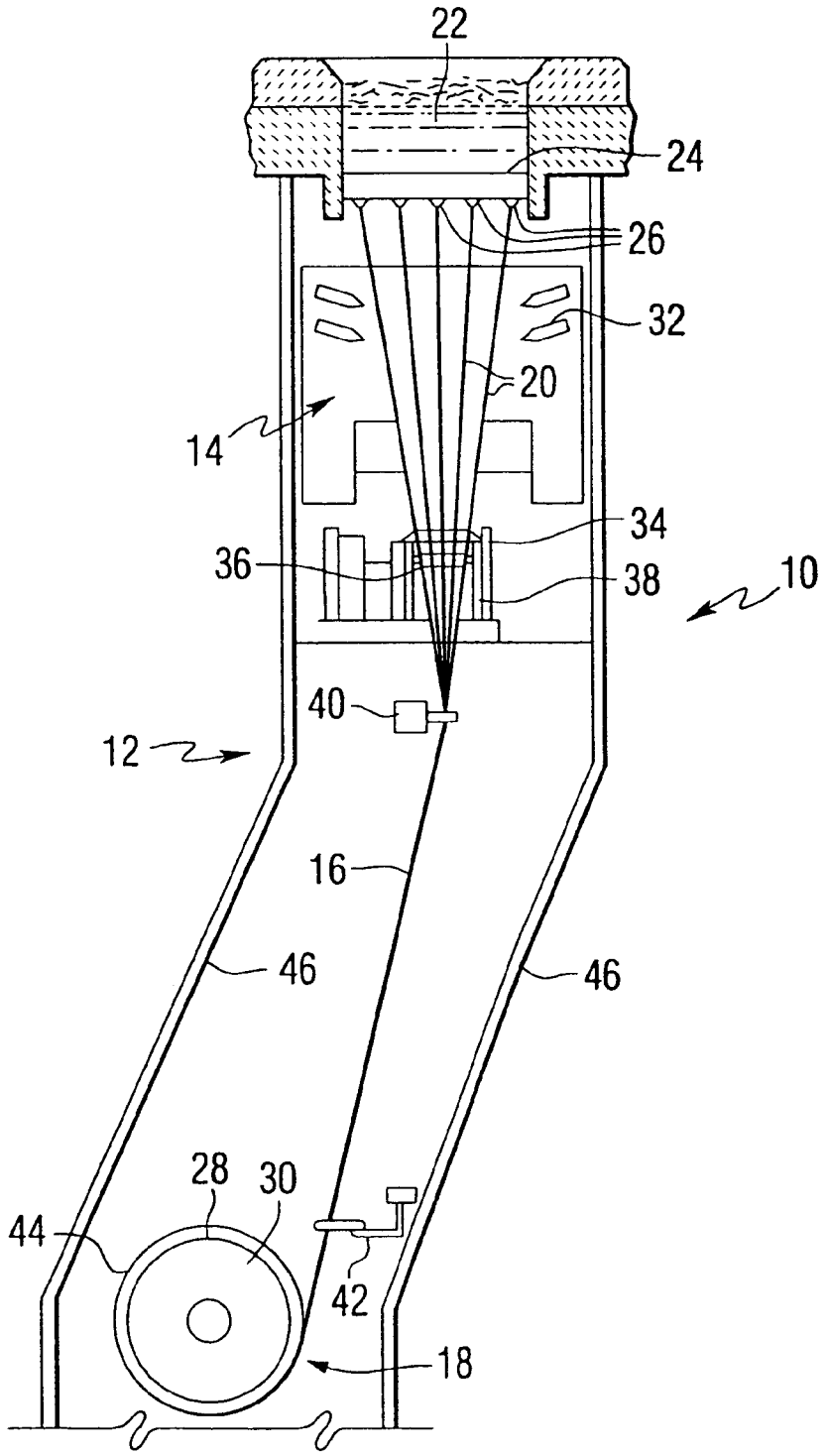
FIG. 1 PRIOR ART
FIG. 1 is a schematic of a typical glass fiber forming station.

The present invention provides a system for doffing at least one forming package, and preferably several forming packages, from a winder and re-tubing the winder for production of additional forming packages. As used herein, the terms "doff" or "doffing" means the removal of one or more forming packages from a fiber winder and the terms "re-tube" or re-tubing" means the positioning of one or more forming tubes on the winder. In addition, as used herein, the term "forming tube" means a cylindrically shaped tube member around which continuous fiber strands are wound on a winder, the term "fiber cake" means the assemblage of the continuous strands wound around the forming tube, and "forming package" means the combination of the forming tube with the fiber cake.

While the disclosure of the present invention will generally be discussed in connection with its use in continuous glass fiber forming operations, it will be recognized by one skilled in the art that the present invention is suitable for use with any continuous fiber forming operation wherein the fibers are wound to form forming packages.

The present invention is particularly well suited for use in glass fiber forming operations. Glass fibers suitable for use in the present invention can be formed from any type of fiberizable glass composition known to those skilled in the art, including, but not limited to, those prepared from fiberizable glass compositions such as "E-glass", "A-glass", "C-glass", "D-glass", "R-glass", "S-glass" and E-glass derivatives. As used herein "E-glass derivatives" means glass compositions that include minor amounts of fluorine and/or boron, and preferably are fluorine-free and/or boron-free. Furthermore, as used herein, "minor" means less than 0.5 weight percent fluorine and less than 5 weight percent boron. Preferred glass fibers are formed from E-glass and E-glass derivatives. Such compositions are well known to those skilled in the art. If additional information is needed, such glass compositions are disclosed in K. Loewenstein, *The Manufacturing Technology of Continuous Glass Fibres*, (3d Ed. 1993) at pages 30–44, 47–60, 115–122 and 126–135 and U.S. Pat. Nos. 4,542,106 (see column 2, line 67 through column 4, line 53) and 5,789,329 (column 2, line 65 through column 4, line 24), which are hereby incorporated by reference.

The glass fibers can have a nominal filament diameter ranging from about 3.0 to about 35.0 micrometers (corresponding to a filament designation of B through U and above). For further information regarding nominal filament diameters and designations of glass fibers, see Loewenstein at page 25, which is hereby incorporated by reference.

As discussed above, the present invention is useful in fiber forming operations other than glass fiber forming operations (i.e. "non-glass fiber" forming operations). Suitable non-glass fibers which can be used in accordance with the present invention are discussed at length in the *Encyclopedia of Polymer Science and Technology*, Vol. 6 (1967) at pages 505–712, and U.S. Pat. No. 5,883,023 (see column 10, line 38 through column 11, line 10), which are hereby incorporated by reference.

Referring to FIG. 1, a forming station 10 of a glass fiber forming operation includes a forming apparatus 12 having a strand supply device 14 for supplying at least one strand 16 to a winder 18. As used herein, the term "strand" means a plurality of continuous fibers 20. Fibers 20 are supplied from a glass melting furnace or forehearth (not shown) containing a supply of a fiber forming molten glass 22 and having a metal bushing 24 attached to the bottom of the forehearth. During the glass melting phase, the glass is typically heated to a temperature of at least about 2550° F. (1400° C.). The molten glass 22 is drawn through a plurality of nozzles 26 in the bushing 24 and attenuated to form fibers 20 by winding a strand 16 of fibers 20 on a forming tube 28 mounted on a rotatable collet 30 of winder 18. More particularly, to start the attenuation process, the strands 16 are typically wrapped around the end cap of the collet 30. When the winder 18 is up to speed, i.e. it is rotating the collet 30 at the speed required to attenuate the fibers 20 and form the desired fiber configuration, the strands 16 are moved from the end cap to their respective forming tubes 28. Water sprays 32 can be positioned below the bushing 24 to spray water at the newly formed fibers 20 to cool them after being drawn from the bushing 24. For clarity in the drawing, the refractory materials, cooling tubes and fins typically surrounding the metal bushing have been omitted. Alternatively, the forming apparatus 12 can be, for example, a forming device for synthetic textile fibers or strands in which fibers are drawn from nozzles, such as, but not limited to, a spinneret, as is known to those skilled in the art. Typical forehearths and glass fiber forming arrangements are shown in Loewenstein at pages 85–107 and pages 115–135, which are hereby incorporated by reference.

Typically, immediately after the glass fibers 20 are drawn from the bushing 24 and attenuated and prior to the fibers being wound about collet 30, they are contacted with an applicator 34 to apply a coating or sizing composition to at least a portion of the surface of the glass fibers 20 to protect the fiber surface from abrasion during processing. Typical sizing compositions for glass fibers are aqueous and can include as components, among other constituents, film-formers, lubricants, coupling agents, and emulsifiers. Non-limiting examples of sizing compositions are disclosed in U.S. Pat. Nos. 3,997,306 (see column 4, line 60 through column 7, line 57); 4,305,742 (see column 5, line 64 through column 8, line 65) and 4,927,869 (see column 9, line 20 through column 11, line 19), 5,908,689 (see column 4 line 24 through column 7 line 31 and column 15 line 47 through column 21 line 39) and 5,883,021 (see column 6 line 7 through column 9 line 19), which are hereby incorporated by reference. Additional information and further non-limiting examples of suitable sizing compositions are set forth in Loewenstein at pages 237–291, which is hereby incorporated by reference.

The applicator 34 typically includes a roller 36 having a generally cylindrical surface positioned within an enclosure 38. The enclosure 38 further includes a sizing reservoir. The roller 36 is positioned within the enclosure 38 such that a portion of the roller surface is submerged within the sizing composition. As the roller 36 is rotated within the enclosure 38, its surface is coated with a film of the sizing which thereafter coats at least a portion of the surface of the fibers which pass over and contact the roller surface, in a manner well known in the art. For additional information regarding applicators, see Loewenstein at pages 165–172, which is hereby incorporated by reference.

A gathering device 40 mounted at the forming station 10 in any convenient manner is used to gather selected groups of fibers 20 and form one or more strands 16. The strands 16 typically have about 100 to about 15,000 fibers per strand, and preferably about 200 to about 7,000 fibers, and are drawn through the gathering device 40 at speeds of about 2,500 to about 18,000 feet per minute (about 762 to about 5,486 meters per minute). Although not limiting in the instant invention, the gathering device 40 typically divides the fibers 20 to form up to about 20 strands.

The forming apparatus 12 also includes a spiral 42 for placing the strands 16 in a given pattern on the forming tube 28 positioned upon the reciprocating, rotatable collet 30 of winder 18 to produce a forming package 44. The strands 16 are directed to one of several forming tubes 28 on the winder 18 so that several forming packages 44 (shown in FIG. 4) can be formed on the single collet 30. Sidewalls 46 are positioned to generally enclose the forming station 10 and isolate the bushing 24, applicator 34, gathering device 40, strands 16 and fibers 20 from similar elements in adjacent forming stations. Sidewalls 46 also provide support for other devices, such as, for example, additional water sprays and air cooling ducts, that can be used at the forming station 10 in forming the strands 16.

The present invention provides an apparatus and method for removing at least one, and preferably multiple forming packages from the collet 30. In the following discussion, the invention is presented in conjunction with doffing multiple forming packages from the collet of a winder and re-tubing the collet with multiple forming tubes, but it should be appreciated that the present invention can also be used for doffing and re-tubing a single forming package and single forming tube. More specifically, referring to FIG. 2 and as discussed earlier, winder 18 includes rotatable collet 30 adapted to receive one or more forming tubes 28 for forming glass fiber forming packages. Forming tubes 28 are typically made of plastic or reinforced paper. In the particular embodiment of the invention shown in FIG. 3, collet 30 is configured to receive three forming tubes 28A, 28B and 28C. When the winding operation is complete, it is difficult and time consuming to remove each individual forming package and re-tube the collet with additional forming tubes for the next set of forming packages. In addition, the fiber strands that have been wrapped around the collet end cap must be cut and removed from the collet before the strand packages can be removed.

Figures 2, 3, 4:
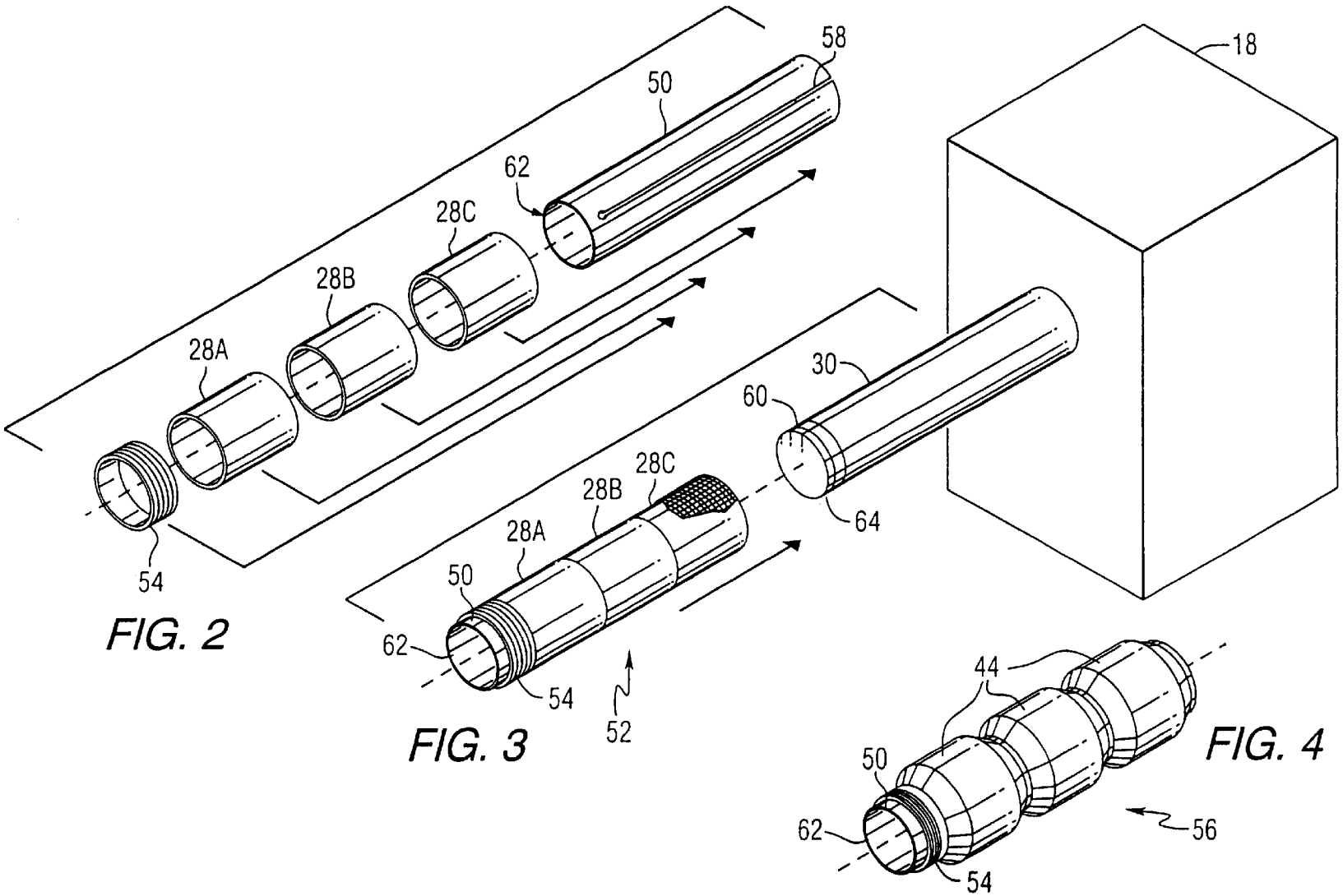
FIG. 2 is an exploded isometric view of a forming tube assembly incorporating features of the present invention.
FIG. 3 is an isometric view of a forming tube assembly on a single collet winder incorporating features of the present invention.
FIG. 4 is an isometric view of a forming package assembly incorporating features of the present invention.

To solve this problem, the present invention uses an adapter tube 50, as shown in FIGS. 2, 3 and 4, to position forming tubes on and remove forming packages from the collet 30 of winder 18. More specifically, adapter tube 50 extends generally along the length of the collet 30 and the forming tubes 28 are fitted around the adapter tube 50 to form a forming tube assembly 52. As used herein, the term "forming tube assembly" means the combination of one or more forming tubes 28, and optionally a starter band 54 (discussed below), on an adapter tube 50, as shown in FIG. 2. Although not required, in one nonlimiting embodiment of the invention, the forming tube assembly 52 can be preassembled and positioned as a single unit on the winder collet 30 to simultaneously re-tube the collet 30 with multiple forming tubes 28 and prepare the collet 30 for subsequent winding of the strands 16 to form forming packages, as will be discussed later in more detail. During the winding operation, strands are wound around the forming tubes 28 to form multiple forming packages 44 and a forming package assembly 56 as shown in FIG. 4. As used herein, the term "forming package assembly" means the combination of one or more forming packages 44, and optionally starter band 54, on an adapter tube 50. When the winding operation is complete, all the forming packages 44 in the forming package assembly 56 can be simultaneously removed from the collet 30 by sliding the adapter tube 50 from the collet 30, as will be discussed later in more detail.

The present invention also incorporates the use of a starter band 54. The starter band 54 is positioned on adapter tube 50 as shown in FIGS. 2–4 and replaces the need to wind the fiber strands 16 around the collet end cap to begin the fiber attenuation process. More specifically, in the fiber winding operation of the present invention, the fiber strands are wound around the starter band 54 as the collet 30 is rotating to begin the fiber attenuation. When the speed of the collet 30 reaches that required to provide the desired fiber size, the strands 16 are moved from the starter band 54 to their respective forming tubes 28 to form the forming packages 44. After the forming package assembly 56 is removed from the winder collet 30, as will be discussed later in more detail, the starter band 54 can be removed from the adapter tube 50 and compressed or deformed so that the fiber strands 16 wound around the band 54 can be removed and the band 54 can be reused.

Figure 5:
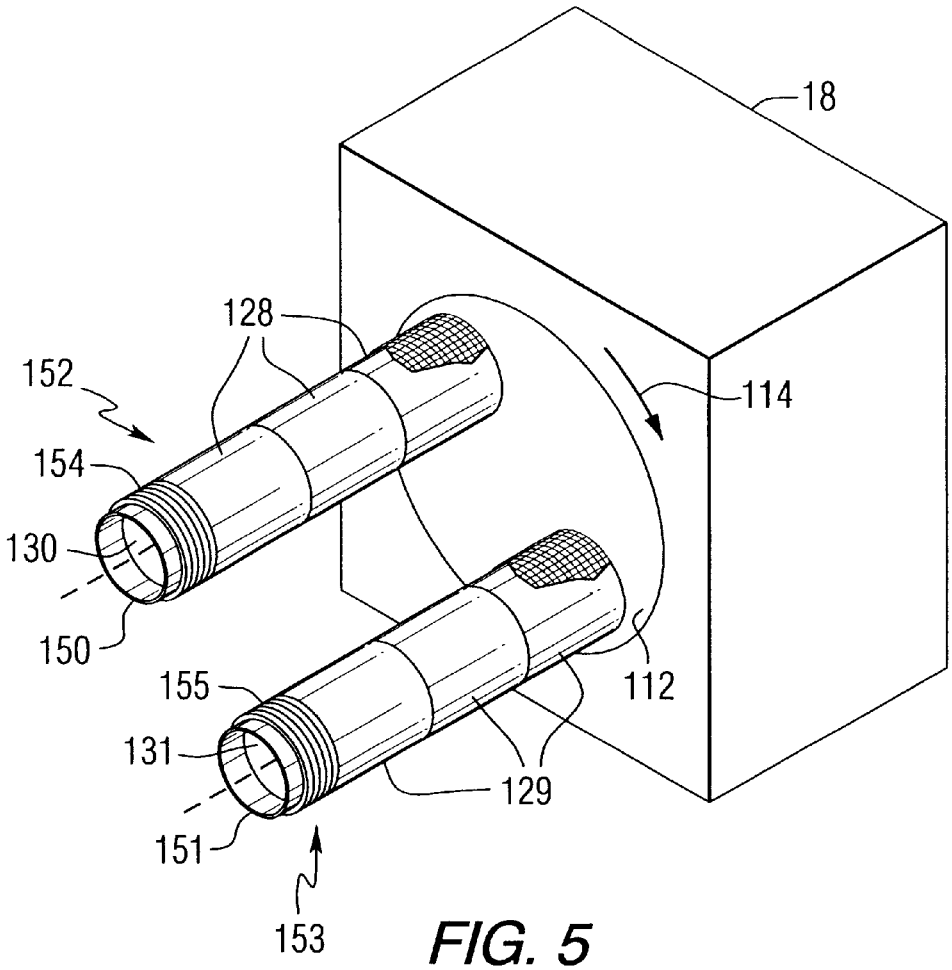
FIG. 5 is an isometric view of an adapter tube on a turret winder incorporating features of the present invention.

It should be appreciated that although FIG. 2 shows the use of the adapter tube 50 in combination with a single collet winder 18, the present invention can be use on a turret winder of a type well know in the art. More specifically, referring to FIG. 5, turret winder 118 includes two collets 130 and 131 secured to a rotatable plate 112. In the winder arrangement shown in FIG. 5, a forming tube assembly 152 including an adapter tube 150, a starter band 154 and forming tubes 128 positioned thereon, is mounted on upper collet 130 and the glass fibers are wound around forming tubes 128. A second forming tube assembly 153 including an adapter tube 151, a starter band 155 and forming tubes 129, is positioned on lower collet 131. When the formation of the forming packages on the upper collet 130 is complete, plate 112 rotates in the direction indicated by arrow 114 to move collet 130 from its upper position to the lower position previously occupied by collet 131, and to move collet 131 from its lower position to the upper position previously occupied by collet 130. The strand can then be engaged by starter band 155 and subsequently directed to the appropriate forming tubes 129 on adapter tube 151 to form the next set of forming packages while forming package assembly, which includes adapter tube 150 and forming packages incorporating forming tubes 128, is removed from collet 130. Once removed, a preassembled forming tube assembly comprising an adapter tube, starter band and forming tubes can be slid over collet 130 as strand is being wound around forming tubes 129, so that collet 130 can be rotated to its original position after formation of forming packages on forming tubes 129 is complete.

Adapter tube 50 should be sufficiently strong so that the tube will not rip or break when the forming package assembly 56 is removed from the collet 30 during doffing and sufficiently stiff so as not to buckle when the forming tube assembly 52 is slid onto the collet 30 during re-tubing. In addition, it is preferred that the adapter tube 50 be made from a flexible material so that it can conform to the changing shape of the collet 30, as will be discussed later. Although not limiting in the present invention, adapter tube 50 is made from reinforced paper, rubber or plastic material. Non-limiting examples of suitable plastics include polyester materials, epoxy materials, polyolefin materials, e.g. polypropylene, and combinations thereof.

Although not required, in the nonlimiting embodiment of the invention shown in FIG. 3, tube 50 includes a slit 58 along at least a portion of its length so that its diameter can be easily reduced to facilitate removal of the forming packages 44 and positioning of new forming tubes 28 along the adapter tube 50. In addition, the slit 58 allows the diameter of the adapter tube 50 to increase to conform to the expanded surface configuration of the collet 30 which results when the collet fingers (not shown) extend from the surface of the collet 30 during winding to increase its effective diameter and engage and secure the adapter tube 50. As the diameter of the collet 30 and adapter tube 50 increases, the adapter tube 50 firmly engages the forming tube 28 and starter band 54.

It is preferred that the adapter tube 50 extend slightly beyond starter band 54 and end 60 of the collet 30 so that a doffing and re-tubing device (shown schematically in FIGS. 6, 7 and 9 and will be discussed below in more detail) can grip end 62 of the adapter tube 50 and pull it off the collet 30 along with forming packages 44 and starter band 54, as well as push adapter tube 50 along with multiple forming tubes 28 and a starter band 54 onto the collet 30 to re-tube the winder 18.

In one nonlimiting embodiment of the invention, adapter tube 50 is made of reinforced paper and includes a slit 58 along its entire length. Although not limiting in the present invention, the adapter tube 50 was combined with reinforced paper forming tubes 28 and a 3-inch wide, reinforced paper starter band 54 positioned about 2.5 inches (6.35 cm) back from the end of the adapter tube 50.

In another nonlimiting embodiment of the invention, adapter tube 50 is formed from a polypropylene tube having a wall thickness of about 0.066 inch (1.68 mm). The tube included a 0.3125 inch (7.94 mm) wide slit 58 that extends along most of its length, with the slit terminating approximately 1.75 inches (4.45 cm) from the end 62 of the tube 50, i.e. the end of the tube that is engaged by the doffing and re-tubing device. The polypropylene adapter tube has an 11.83 inch (30.05 cm) inner diameter to fit over a nominal 12 inch (30.48 cm) diameter collet. In one nonlimiting collet configuration the collet has a collapsed diameter of about 11.61 inches (29,49 cm) and an expanded diameter of about 11.91 inches (30.25 cm). Approximately 1.75 inches (4.45 cm) of the end 62 of adapter tube 50 extends beyond end 60 of collet 30 so as to provide a portion of the adapter tube 50 that can be engaged by the doffing and re-tubing device. The starter band 54 used in combination with this embodiment of the adapter 50 is a 2.25 inch (5.72 cm) wide polyurethane band that includes a series of annular ribs on its outer surface that engage the fiber strand as fiber attenuation is initiated. The diameter of the forming tubes 28 is sized to fit over both the collet 30 and polypropylene adapter tube 50.

In one nonlimiting embodiment of the invention, the collet 30 of winder 18 includes an expandable end cap 64 (shown in FIG. 3) and the starter band 54 is positioned approximately 2.5 inches (6.35 cm) back from end 62 of tube 50 so that when the forming tube assembly 52 is positioned on the collet 30, the starter band 54 is positioned over the end cap 64 of the collet 30. The end cap 64 is expanded after forming tube assembly 52 is positioned on the collet 30 to ensure tight fit of the starter band 54 as the strand is wound around the starter band 54 during initiation of fiber attenuation. In one nonlimiting endcap configuration, the endcap expands from a diameter of about 11.44 inches (29.06 cm) to about 11.92 inches (30.28). In one nonlimiting embodiment of the invention, the doffing and re-tubing device expands the end cap 64 after positioning the forming tube assembly 52 on collet 30 and retracts the end cap 64 prior to removal of the forming package assembly 56 so that the adapter tube 50, starter band 54 and forming packages 44 can be removed from the collet 30. Although not limiting in the present invention, the end cap 64 can be configured as taught in U.S. Pat. No. 5,769,342, which is hereby incorporated by reference. In addition, in a nonlimiting embodiment of the end cap 64, air pressure is used to inflate and expand the end cap, and the air pressure is released to deflate and retract the end cap.

Figure 6:
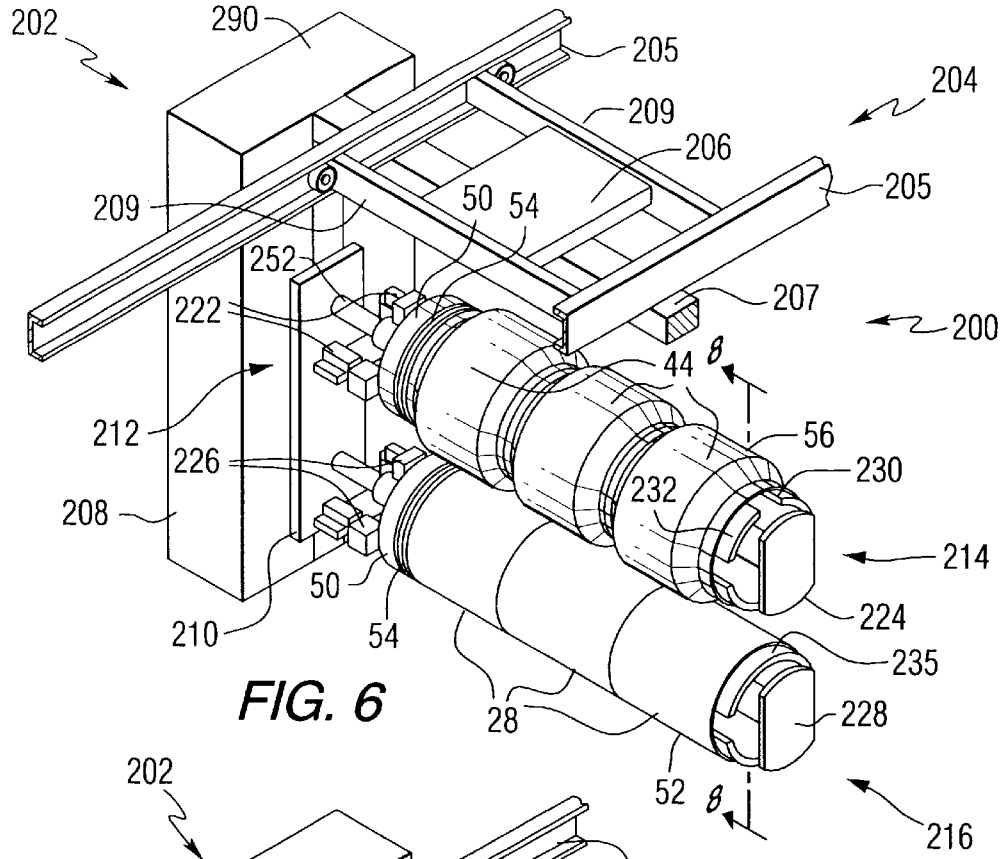
FIGS. 6 and 7 are isometric views of a doffing and re-tubing device incorporating features of the present invention, with portions removed for clarity.
Figure 7:
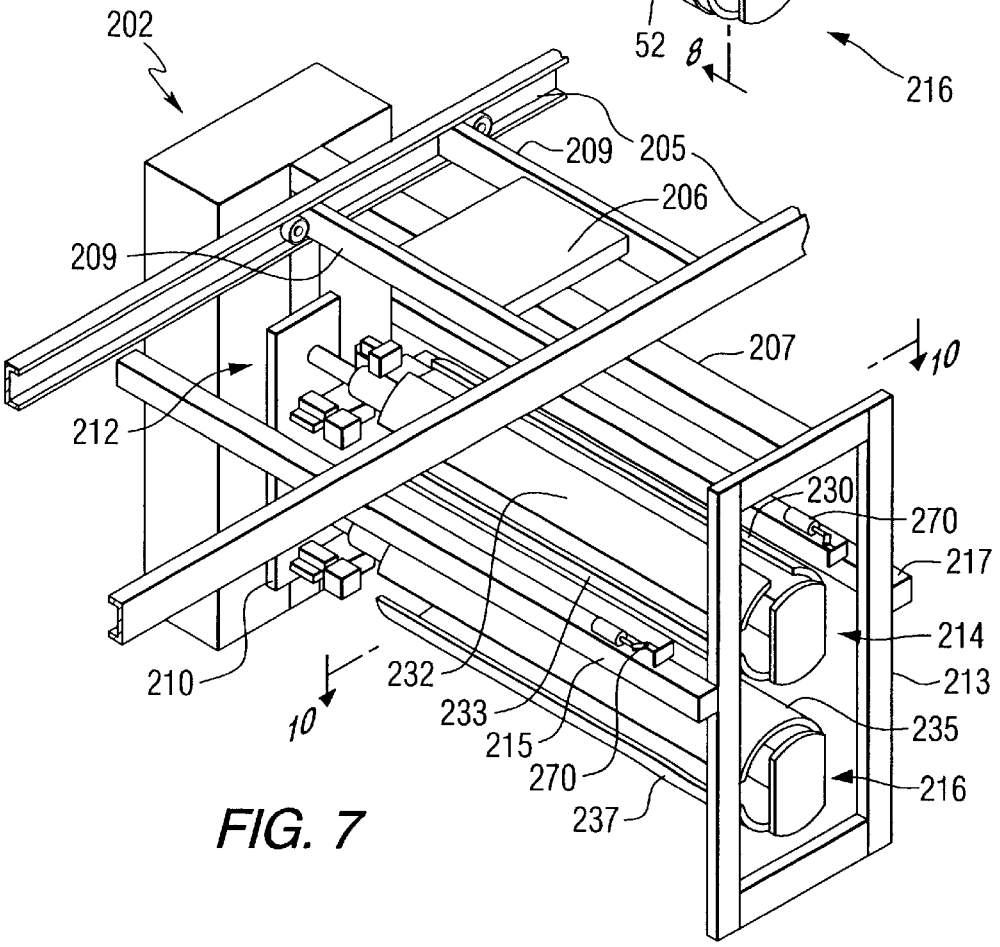
Figure 9:
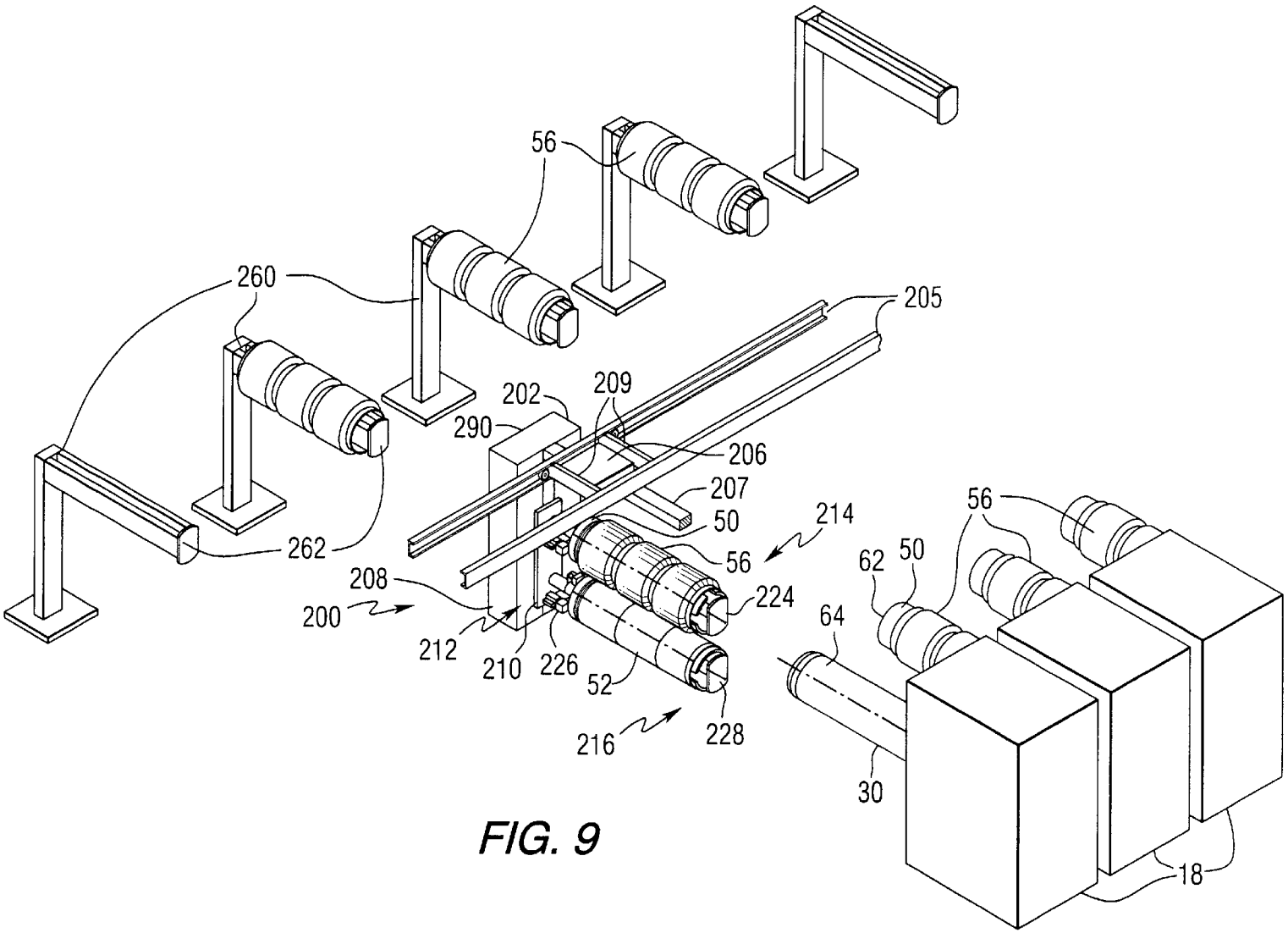
FIG. 9 is a view of a doffing and re-tubing system incorporating features of the present invention, with portions removed for clarity.

FIGS. 6, 7 and 9 illustrate a schematic of the nonlimiting doffing and re-tubing device discussed earlier. In particular, FIG. 6 illustrates device 200 while supporting a forming tube assembly 52 and a forming package assembly 56, with portions of the gantry framing removed for clarity. FIG. 7 illustrates a gantry 202 of device 200 while not supporting any assembly 52 or 56. Referring to FIG. 6, the device 200 includes a gantry 202 supported by an overhead transport system 204, and in particular a pair of rails 205. Gantry 202 is supported from and movable via a drive (not shown) along rails 205 by a carriage 206 so that the gantry 202 is horizontally movable from collet to collet along the rails 205. The gantry 202 is supported from carriage 206 by a support beam 207 which extends from a support post 208 of the gantry 202. Carriage 206 also includes a set of rails 209 that extends between rails 205 and allows the carriage 206, and thus gantry 202, to move in a horizontal direction transverse to the rails 205, and more specifically, move toward and away from a collet. The carriage 206 can also rotate about a vertical axis to provide rotation of the gantry 202, as will be discussed later in more detail. The support post 208 of gantry 202 is slidably engaged by a support plate 210 of a support assembly 212. A drive (not shown) is used to move the support plate 210 and support assembly 212 vertically along the support post 208, as will be discussed later in more detail. Referring to FIG. 7, the gantry 202 further includes a frame 213 positioned opposite support post 208 and supported by support beam 207 and side beams 215 and 217.

Figure 8:
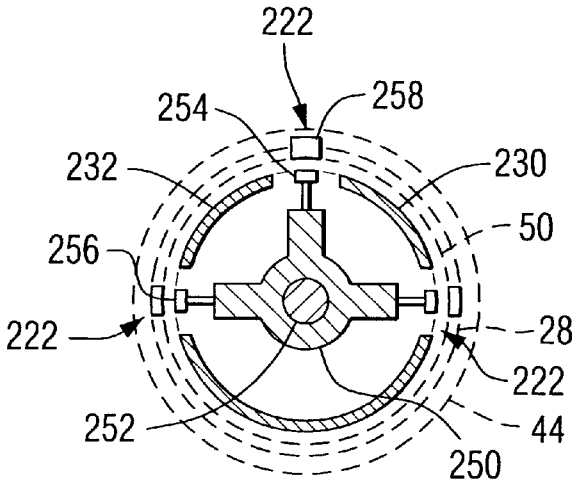
FIG. 8 is a view through line 8—8 in FIG. 6, with portions removed for clarity.

Support assembly 212 of gantry 202 further includes assembly supports 214 and 216 that are secured to and extend from support plate 210. In the particular embodiment of doffing and re-tubing device 200 shown in FIGS. 6, 7 and 9, the upper assembly support 214 is used to remove a forming package assembly 56 from a winder 18 while the lower assembly support 216 is used to re-tube the winder 18 with a preassembled forming tube assembly 52. Referring to upper assembly support 214, a plurality of gripper mechanisms 222 are moveable along the length of the support assembly 214 between a first position, wherein the gripper mechanisms 222 are at end 224 of assembly support 214 and a second position as shown in FIG. 6, wherein the gripper mechanism is positioned adjacent to support plate 210. When at their first position, the gripper mechanisms 222 can engage end 62 of an adapter tube 50 of a forming package assembly 56 positioned on collet 30 of winder 18. The gripper mechanisms 222 can then move to their second position and pull the forming package assembly 56 off the winder collet 30 and slide it onto the upper assembly support 214, as shown in FIG. 6 and will be discussed later in more detail. The lower assembly support 216 similarly includes a plurality of gripper mechanisms 226 moveable along the length of the lower assembly support 216 between a first position adjacent the support plate 210 as shown in FIG. 6, wherein gripper mechanisms 226 can engage end 62 of an adapter tube 50 of a forming tube assembly 52 supported on assembly support 216, to a second position at end 228 of the lower assembly support 216, wherein as the gripper mechanisms 226 move from their first to second position, they push the forming tube assembly 52 off the lower assembly support 216 and onto the collet 30 of a winder 18. Drive assemblies for the gripper mechanisms 222 and 226 are not shown for clarity; however, as would be appreciated by one skilled in the art, the gripper mechanisms 222 and 226 can be moved along rails or any other type of guide system and can be reciprocated by a variety of different types of drive systems well known in the art, such as but not limited to gears, ball screws and linear actuators. In one nonlimiting embodiment of the invention illustrated in FIG. 8, the upper assembly support 214 include three gripper mechanisms 222 mounted on a support 250 that slides along a rail 252 that extends the length of the support assembly 214. Without limiting the present invention, in the embodiment shown in FIG. 8, each gripper mechanism 222 includes a reciprocating member 254 with teeth extending from its outwardly facing surface 256. To engage the adapter tube 50 when positioned at the end 62 of the adapter tube 50, as will be discussed later in more detail, member 254 moves outward and presses a portion of tube end 62 against a backing plate 258 to secure the portion of end 62 therebetween. Gripper mechanism 222 can then move along upper assembly support 214 and slide forming package assembly 56 with forming packages 44 along the upper assembly support 214. If desired, lower support assembly 216 can include the same type of slide arrangement. However, since the weight of the forming tube assembly 52 is less than that of the forming package assembly 56, it is expected that fewer gripper mechanisms 226 will be required on lower assembly support 216. Assembly support 214 can also include guide plates 230, 232 and 233, and assembly support 216 can include guide plates 235 and 237 along which the adapter tube 50 of the forming package assembly 56 and forming tube assembly 52 can slide on the respective assemblies as the assemblies are removed from or positioned on the collet 30 of winder 18.

The following is a description of one nonlimiting method in which the doffing and re-tubing device 200 shown in FIGS. 6, 7 and 9 can be used in a glass fiber forming operation. In particular, referring to FIG. 9, a system includes a plurality of collet winders 18 and a plurality of package supports 260 with doffing and re-tubing device 200 positioned therebetween. At the beginning of the operating cycle, the upper assembly support 214 of support assembly 212 is empty with gripper mechanisms 222 at their first position, and the lower assembly support 216 includes a forming tube assembly 52 with gripper mechanisms 226 at their first position. The gantry 202 moves horizontally along the support rails 205 until it is aligned with a winder 18 that has completed a fiber winding cycle and its collet 30 is supporting a forming package assembly 56. In one nonlimiting embodiment of the winder 18, after the fiber winding cycle is complete, the collet 30 is indexed outward from the winder 18 along the collet centerline. This moves the forming package assembly 56 away from the forming station 10 and makes it more accessible by the doffing and re-tubing device 200. The support plate 210 and support assembly 212 then moves vertically along the support post 208 until the upper assembly support 214 is vertically aligned with the collet 30. The carriage 206 then moves horizontally along the rails 209 to move the gantry 202 such that the end 224 of the upper assembly support 214 is positioned inside the over hanging end 62 of adapter tube 50 of forming package assembly 56 and a fitting (not shown) at end 224 can engage the expandable end cap 64 at end 60 of collet 18, which has been expanded by air pressure to secure the adapter tube 50 and starter band 54, and deflate it. Gripper mechanisms 222 then engage end 62 of the adapter tube 50 and move to their second position, sliding the forming package assembly 56 off the collet 30 and onto the upper assembly support 214. Support assembly 212 is then moved to re-tube the collet 30. More particularly, the support plate 210 moves upwardly along the support post 208 so as to align the lower assembly support 216 with the empty collet 30 and positions end 228 of the lower assembly support 216 adjacent to end 60 of collet 30 of winder 18. The gripper mechanisms 226 on the lower assembly support 216 then moves from their first position to their second position so as to slide the forming tube assembly 52 off the lower assembly support 216 and onto the collet 30 and a fitting (not shown) at end 228 of lower assembly support 216 engages to the end 60 of the collet 18 and inflates end cap 64 to expand it. The gripper mechanisms 226 then disengage the adapter tube 50. The gantry 202 is then moved away from the winder 18 by sliding the carriage 206 along rails 209 while the collet 30 is repositioned on the winder 18 to begin the next fiber winding operation. The gantry 202 is then rotated about a vertical axis so that the assembly supports 214 and 216 are now facing the package supports 260. The gantry 202 next moves horizontally along the rails 205 until the upper assembly support 214 is aligned with an empty package support 260. The support assembly 212 then moves vertically via support plate 210 along support post 208 to vertically align the upper assembly support 214 with the package support 260. The gantry 202 is then advanced horizontally along rails 209 to move end 224 of the upper assembly support 214 immediately adjacent end 262 of the package support 260. The gripper mechanisms 222 then moves from their second position to their first position, thereby sliding the forming package assembly 56 off the upper assembly support 214 and unloading it onto the package support 260. The gantry 202 is then moved away from the package support 260 along rails 205 and 209 and a preassembled forming tube assembly 52 is positioned on the lower assembly support 216 prior to the initiation of the next cycle. Positioning of the preassembled forming tube assembly 52 on the lower assembly support 216 can be done either manually or automatically.

It should be appreciated that in the above nonlimiting embodiment of the invention, wherein grippers 226 push the forming tube assembly 52 off the lower assembly support 216, if the grippers 226 are not used to pull an x assembly onto the lower assembly support 216 the grippers 226 can be replace with pusher devices (not shown) that simply push the forming tube assembly rather than grip it as does grippers 226. However, where the lower assembly support 216 must perform additional functions, for example as discussed below, grippers 226 are preferred.

As an alternative to unloading the forming packages, starting tube, and adapter tube of the forming package assembly 56 at the package support 260, a stripping device 270 as will be discussed later in more detail, can be positioned either on the gantry 202 as shown in FIG. 7 or at the package support 260, which will strip the forming packages 44 and starter band 54 off the adapter tube 50. More particularly, during the unloading operation, after the gripper mechanism 222 has moved from its second position to its first position and unloaded the forming package assembly 56 from the upper assembly support 214, the stripper device 270 can move into place to engage the adapter tube 50 of the forming package assembly 56 on the package support 260 so that the gripper mechanisms 222 can maintain engagement with the adapter tube 50 and return to their second position on the upper assembly support 214 while the stripper device holds the forming packages 44 and starter band 54 on the package support 260. In this manner, the adapter tube 50 is slid out from under the forming packages 50 and starter band 54 and is repositioned on the upper assembly support 214. The adapter tube 50 can then be removed from the upper assembly support 214 either automatically or manually. As an alternative, a new starter band and forming tubes can be positioned on the adapter tube and the doffing and re-tubing cycle can be repeated except that the lower assembly support 216 will now doff the forming package assembly 56 and the upper assembly support 214 will re-tube the collet 30 with a preassembled forming tube assembly 52. As another alternative, support plate 210 can be rotated about a horizontal axis so that the upper assembly support 214 moves to the lower assembly support position and the lower assembly support 216 moves to the upper assembly support position. A starter band and forming packages can then be positioned on the adapter tube that is already positioned on the new lower assembly support. It should be appreciated that with these later two alternatives, both the upper and lower assembly supports should have the capability to inflate and deflate the inflatable end cap of the collet.

Figure 10:
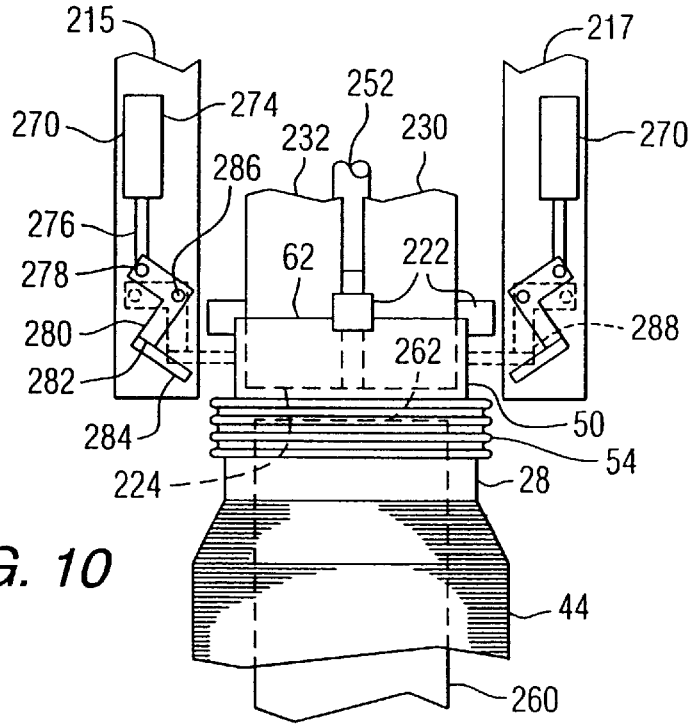
FIG. 10 is a view taken along line 10—10 of FIG. 7, with portions removed for clarity.

In one nonlimiting embodiment of the invention and referring to FIG. 10, stripper devices 270 is mounted on support beams 215 and 217 of gantry 202 and include a cylinder 274 having a reciprocating piston rod 276 pinned to one end 278 of a pivoting link 280. The other end 282 of the link 278 includes a stripping member 284. Link 278 is mounted on support beams 215 and 217 such that it can pivot about mount 286. In operation, as the forming package assembly 56 is unloaded from the upper support assembly 214, the stripping device is in a first position as shown in FIG. 10 to allow the forming package assembly 56 to be removed from the doffing and re-tubing device 200. More specifically, the rod 276 of cylinder 274 is in a retracted position so that stripping member 284 is spaced from the adapter tube 50. Once unloaded and while the gripper mechanism 222 is still engaging end 62 of the adapter tube 50, the stripper device 270 moves to a second position wherein cylinder 274 extends rod 276, which in turn pivots link 280 about mount 286 and moves stripping member 284 into contact with the adapter tube 50, as shown in the phantom lines 288 in FIG. 10. As discussed above, the gripper mechanisms 222 can then move back to their second position on upper support assembly 214 and stripping member 284 will keep the starter band 54 and forming packages 44 on the package support 260. After the adapter tube 50 is removed from the package support 260, the stripper device 270 is pivoted back to its first position.

As should be appreciated by one skilled in the art, the movement of the apparatus discussed above and their individual components is controlled by one or more controllers. Although not required, in the particular embodiment of the invention shown in FIGS. 6, 7 and 9, the support post 208 includes a controller 290 to control the doffing and re-tubing operation. It should also be appreciated that several of the movements discussed above can be performed simultaneously. For example, and without limiting the present invention, the support assembly 212 can simultaneously move horizontally along rails 205 and 209 and vertically along support post 208 to align upper assembly support 214 with a collet 30.

Figure 11:
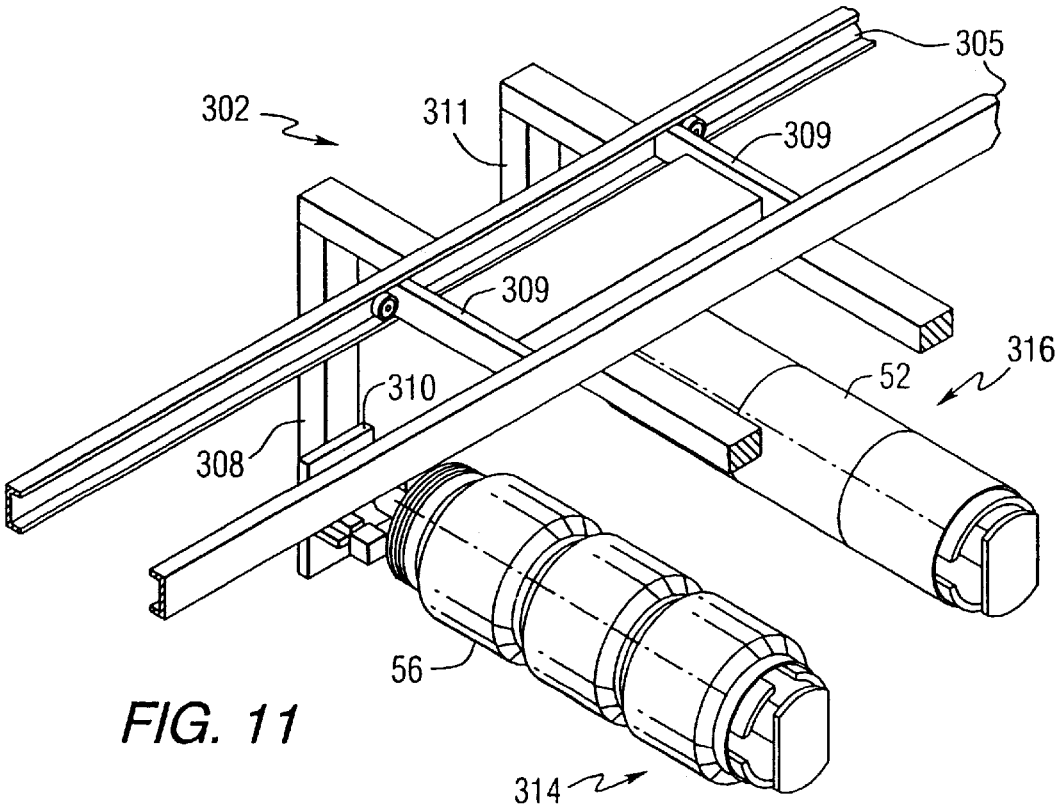
FIG. 11 is a view similar to FIG. 6 of an alternate embodiment of the doffing and re-tubing device, with portions removed for clarity.

FIG. 11 illustrates a nonlimiting alternate embodiment of a doffing and re-tubing device. More specifically, rather than moving upper and lower assembly supports vertically along a guide post as a forming package assembly is removed from a winder and the collet is re-tubed with a forming tube assembly as discussed above, the doffing and re-tubing device can be configured to position the assembly supports side by side. More particularly, referring to FIG. 11, gantry 302 includes a support assembly having a forming package assembly support 314 which extends from a first support plate 310 and a forming tube assembly support 316 which extends from a second support plate (not shown). In operation, gantry 302 moves horizontally along rails 305 and 309 and forming package assembly support 314 moves vertically along support post 308 to align forming package assembly support 314 with a collet of a winder. A forming package assembly 56 is removed from the collet in a manner as discussed above. However, to re-tube the collet, the gantry 302 is moved horizontally and the forming tube assembly support 316 moves vertically along support post 311 to align forming tube assembly support 316 with the collet and the forming tube assembly is positioned on the collet in a manner as discussed above. If desired, forming package assembly support 314 and forming tube assembly support 316 be supported on a common support plate so that both assembly supports move vertically together.

The doffing and re-tubing devices discussed above combine the removal of the forming package assembly and its replacement with a forming tube assembly into a single device. It should be appreciated that the doffing and re-tubing procedures can each be performed by a separate device incorporating the features of the present invention as discussed above.

It will be appreciated by those skilled in the art that changes could be made to the embodiments described above without departing from the broad inventive concept thereof. It is understood, therefore, that this invention is not limited to the particular embodiments disclosed, but it is intended to cover modification which are within the spirit and scope of the invention, as defined by the appended claims.

We claim:

1. An apparatus for doffing and re-tubing a fiber winder, comprising:

(a) an assembly support;

(b) a support plate vertically movable along the assembly support;

(c) a first assembly support extending from the support plate for supporting a forming package assembly comprising an adapter package and at least one forming package extending around the adapter tube, the first assembly support comprising:

(i) at least one gripper movable along the first assembly support between a first position and a second position and capable of engaging the forming tube assembly; and (ii) guides to support and guide the forming package assembly on the first assembly support;

(d) a second assembly support extending from the support plate for supporting a forming tube assembly comprising an adapter tube and at least one forming tube extending around the adapter tube, the second assembly support comprising:

(i) at least one pusher movable along the second assembly support between a first position and a second position and capable of engaging the forming tube assembly; and (ii) guides to support and guide the forming tube assembly on the second assembly support; and (e) a transport system capable of supporting the assembly support and horizontally moving the assembly support.

2. The apparatus according to claim 1, wherein the transport system further includes at least one rail and a carriage movable along the rail and secured to the assembly support.

3. The apparatus according to claim 2, wherein the carriage is rotatable about a vertical axis so as to rotate the assembly support.

4. The apparatus according to claim 1, further including a stripper device to remove the at least one forming package from the adapter tube.

5. The apparatus according to claim 1, further including a controller to control at least the horizontal movement of the assembly support, the vertical movement of the support plate and the movement of the first assembly grippers and the second assembly pushers along the first assembly and second assemblies, respectively.

6. A method of removing at least forming package from the collet of a fiber winder and positioning at least one forming tube on the collet, comprising:

(a) providing a doffing and re-tubing device having a first assembly support for supporting a forming package assembly comprising an adapter tube and at least one forming package extending around the adapter tube, and a second assembly support for supporting a forming tube assembly comprising an adapter tube and at least one forming tube extending around the adapter tube;

(b) aligning the first assembly support with a collet of a winder having a forming package assembly such that an end of the first support is close an end of the collet;

(c) engaging the adapter tube of the forming package assembly with the first assembly support;

(d) sliding the forming package assembly off the collet and onto the first assembly support;

(e) aligning the second assembly support with the collet of the winder such that an end of the second assembly support is close the end of the collet; and (f) sliding a forming tube assembly positioned on the second assembly support off the second assembly support and onto the collet.

7. The method according to claim 6, further including the steps of the moving the device and first assembly support to align the first assembly support with a package support such that an end of the first assembly support is close an end of the package support, and sliding the forming package assembly off the first assembly support and onto the package support.

8. The method according to claim 7, further including the step of sliding the adapter tube of the forming package assembly back onto the first assembly support while retaining the at least one forming package on the package support.

9. The method according to claim 6, wherein the forming package assembly includes multiple forming packages and the first sliding step simultaneously removes the multiple forming packages from the collet.

10. The method according to claim 6, wherein the forming tube assembly includes multiple forming tubes and the second sliding step simultaneously positions the multiple forming packages on the collet.

* * * * *